US008382330B2

(12) United States Patent
Chang et al.

(10) Patent No.: US 8,382,330 B2
(45) **Date of Patent: *Feb. 26, 2013**

(54) ILLUMINATING DEVICE AND HEAT-DISSIPATING STRUCTURE THEREOF

(75) Inventors: Sean Chang, Taoyuan Hsien (TW); Kuo-Chiang Tu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 435 days.

This patent is subject to a terminal disclaimer.

(21) Appl. No.: 12/163,144

(22) Filed: Jun. 27, 2008

(65) Prior Publication Data

US 2009/0244900 A1 Oct. 1, 2009

(30) Foreign Application Priority Data

Mar. 28, 2008 (TW) ..... 97111253 A

(51) Int. Cl.
*F21V 29/00* (2006.01)

(52) U.S. Cl. ..... 362/294; 362/249.02; 362/218; 362/373; 362/800; 362/345

(58) Field of Classification Search ..... 362/249.02, 362/294, 373, 800, 218, 345; 165/80.3, 185; 361/688–690, 697, 704, 700, 709, 714; 174/16.1, 174/16.3

See application file for complete search history.

(56) References Cited

U.S. PATENT DOCUMENTS

| | | | | |
|---|---|---|---|---|
| 5,172,975 | A | 12/1992 | Parker | |
| 5,537,301 | A * | 7/1996 | Martich | 362/218 |
| 6,341,877 | B1 * | 1/2002 | Chong | 362/291 |
| 6,483,254 | B2 * | 11/2002 | Vo et al. | 315/241 S |
| 7,093,958 | B2 * | 8/2006 | Coushaine | 362/249.02 |
| 7,482,632 | B2 * | 1/2009 | Lu et al. | 257/88 |
| 7,568,817 | B2 * | 8/2009 | Lee et al. | 362/294 |
| 7,798,684 | B2 * | 9/2010 | Boissevain | 362/431 |
| 2004/0022057 | A1 * | 2/2004 | Lee | 362/238 |
| 2005/0174769 | A1 * | 8/2005 | Yong et al. | 362/235 |
| 2005/0248943 | A1 * | 11/2005 | Tsai | 362/249 |
| 2006/0126338 | A1 * | 6/2006 | Mighetto | 362/294 |
| 2006/0227534 | A1 * | 10/2006 | Chang et al. | 362/102 |
| 2007/0159827 | A1 * | 7/2007 | Huang | 362/294 |
| 2007/0159828 | A1 | 7/2007 | Wang | |
| 2007/0195527 | A1 * | 8/2007 | Russell | 362/240 |
| 2008/0002410 | A1 * | 1/2008 | Burton et al. | 362/294 |
| 2008/0316755 | A1 * | 12/2008 | Zheng et al. | 362/373 |
| 2009/0027889 | A1 * | 1/2009 | Kang et al. | 362/294 |
| 2009/0116233 | A1 * | 5/2009 | Zheng et al. | 362/234 |
| 2009/0303718 | A1 * | 12/2009 | Zheng et al. | 362/249.02 |

FOREIGN PATENT DOCUMENTS

| | | | |
|---|---|---|---|
| CN | 101545621 | A | 9/2009 |
| EP | 1950491 | A1 | 7/2008 |

(Continued)

*Primary Examiner* — Mary McManmon

(74) *Attorney, Agent, or Firm* — Muncy, Geissler, Olds & Lowe, PLLC

(57) ABSTRACT

The present invention provides an illuminating device and heat-dissipating structure thereof. The heat-dissipating structure includes a plurality of heat-dissipating units stacked together. Each heat-dissipating unit includes a cone-like portion with an opening and a plurality of protrusions connected to the cone-like portion, wherein at least one of the protrusions of one heat-dissipating unit is coupled to that of the adjacent heat-dissipating unit to form one or more zonal planes for allowing a light source to be disposed thereon to constitute the illuminating device, and the openings of the heat-dissipating units are liked together to form an airflow passage.

23 Claims, 13 Drawing Sheets

FOREIGN PATENT DOCUMENTS

| | | | |
|---|---|---|---|
| EP | 2 105 652 | A1 | 9/2009 |
| JP | 2009245916 | A | 10/2009 |
| TW | I340810 | | 4/2011 |
| WO | WO2007/053939 | A1 | 5/2007 |

* cited by examiner

ILLUMINATING DEVICE AND HEAT-DISSIPATING STRUCTURE THEREOF

CROSS REFERENCE TO RELATED APPLICATIONS

This Non-provisional application claims priority under 35 U.S.C §119(a) on Patent Application No(s). 097111253 filed in Taiwan, Republic of China on Mar. 28, 2008, the entire contents of which are hereby incorporated by reference.

BACKGROUND OF THE INVENTION

1. Field of Invention

The present invention relates to an illuminating device and a heat-dissipating structure thereof, and in particular to an illuminating device having a cone-like heat-dissipating structure.

2. Related Art

Traditionally, heat sinks are made by aluminum extrusion, metal die casting or metal forging. However, such a manufacturing way has the disadvantages of high cost, overweight, complicated process, large volume, bad efficiency of natural convection, etc. Due to the above problems, another way is to utilize mechanical press to make several fins for being stacked together to constitute a heat sink. However, most of heat sinks are formed by stacked planar fins and such a design will be limited by its shape, so that the direction of the airflow will be limited to a direction in parallel to the stacked direction of fins. Thus, this kind of heat sink needs to be improved by adding a heat pipe or a fan to enhance heat-dissipating efficiency. Further, such kind of heat sink can not attain the purpose of multi-directional natural convection for heat dissipation. Moreover, the conventional light emitting diode (LED) lamp only emits from single side due to the limitation of shape and manufacturing way of the heat sink.

SUMMARY OF THE INVENTION

In view of the foregoing, the invention is to provide an illuminating device and a heat-dissipating structure thereof.

To achieve the above, the present invention discloses a heat-dissipating structure including a plurality of heat-dissipating units stacked together. Each heat-dissipating unit includes a cone-like portion with an opening and a plurality of protrusions connected to the cone-like portion, wherein at least one of the protrusions of one heat-dissipating unit is coupled to that of the adjacent heat-dissipating unit to form one or more zonal planes for allowing a light source to be disposed thereon to constitute the illuminating device, and the openings of the heat-dissipating units are linked together to form an airflow passage.

The heat-dissipating unit is formed by metal stamping. Preferably, the heat-dissipating unit is a pyramid, a conoid or an umbrella-shaped unsymmetrical structure.

Optionally, the protrusion has a fastener for positioning and connecting with the adjacent protrusion and a through hole for accelerating movement of the airflow. The protrusion has preferably a planar or stepped bending portion. The plurality of protrusions are symmetrically or unsymmetrically disposed on the edge of the cone-like portion.

The surface of the heat-dissipating unit is processed physically or chemically for accelerating heat-radiation, for example but not limited to, the anodic treatment or the heat-radiating material coating. The surface of the heat-dissipating unit may also have a microstructure.

The heat-dissipating unit further includes a plurality of apertures. The cone-like portion is formed by a plurality of fins or a single annular fin.

Preferably, the heat source is a light emitting diode (LED), a laser diode, an organic light emitting diode (OLED) or a semiconductor light source.

To achieve the above, another heat-dissipating structure of the present invention comprises at least a heat-dissipating unit including a cone-like portion with an opening and at least a protrusion connected to the cone-like portion.

To achieve the above, an illuminating device of the present invention comprises a light source and a heat-dissipating structure including a plurality of heat-dissipating units stacked together. Each heat-dissipating unit includes a cone-like portion with an opening and at least a protrusion connected to the cone-like portion. The light source is disposed on a plane formed by the protrusions.

Wherein the light source is preferably a light emitting diode, a laser diode, an organic light emitting diode, or a semiconductor light source.

The illuminating device further comprises a transparent housing disposed outside of the heat-dissipating structure and the light source. The transparent housing has one or more vents optionally.

The illuminating device farther comprises a securing structure for fastening the heat-dissipating structure. The securing structure comprises a first part and a second part, and the illuminating device further comprises an electric component disposed in a space formed between the first part and the second part of the securing structure. Of course, the electric component is not needed if the light source is an alternating current LED. The first part has a plurality of through holes optionally.

The illuminating device further comprises a power connector and the type of the power connector is E10/E11, E26/E27, or E39/E40.

BRIEF DESCRIPTION OF THE DRAWINGS

The present invention is more fully understood by reading the subsequent detailed description and examples with references made to the accompanying drawings, wherein.

DETAILED DESCRIPTION OF THE INVENTION

The present invention will be apparent from the following detailed description, which proceeds with reference to the accompanying drawings, wherein the same references relate to the same elements.

Figure 1A:
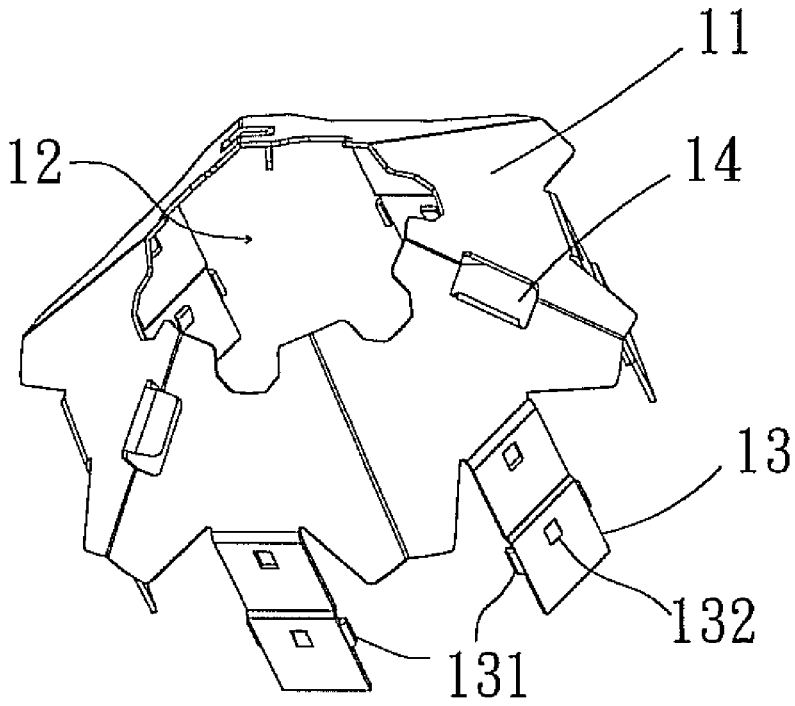
FIG. 1A and FIG. 1B are perspective diagrams of different types of the heat-dissipating units of the heat-dissipating structure according to the present invention.
Figure 1B:
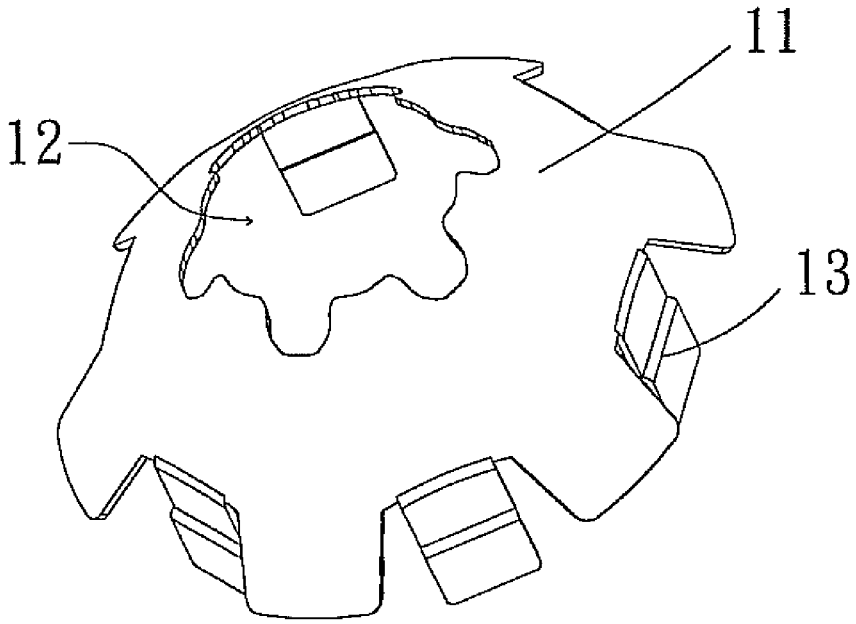
Figure 2A:
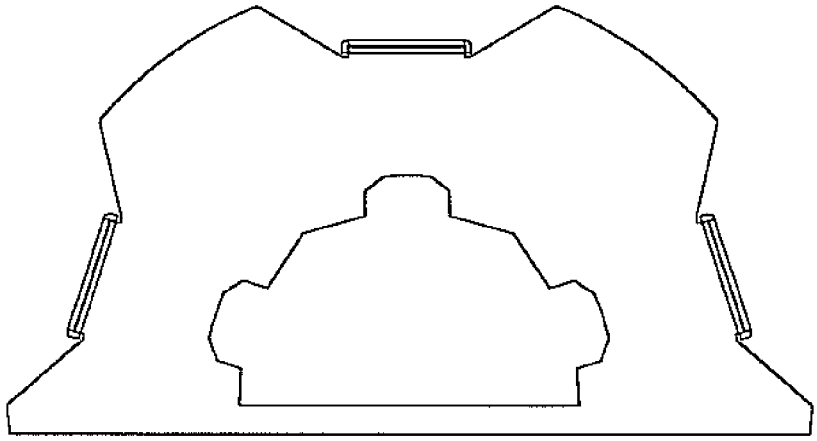
FIG. 2A and FIG. 2B are top views of other types of the heat-dissipating unit of the heat-dissipating structure according to the present invention.
Figure 2B:
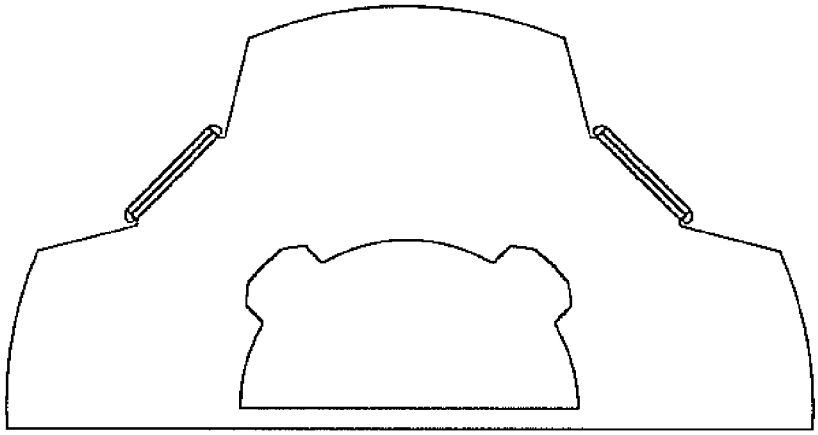

According to the present invention, the heat-dissipating stricture includes one or a plurality of heat-dissipating units stacked together, and the heat-dissipating structure can provide multi-directional natural convection. The heat-dissipating unit is preferably formed by metal stamping, and can be made of various material with different thickness to meet the real requirement. The heat-dissipating unit includes a cone-like portion 11 with an opening 12 and a plurality of protrusions 13 connected to the edge of the cone-like portion 11. The heat-dissipating unit can be an umbrella-shaped pyramid structure or conoid structure as shown in FIG. 1A and FIG. 1B. The heat-dissipating unit can be also a cone-like unsymmetrical structure as shown in FIG. 2A and FIG. 2B.

Referring to FIG. 1A, each protrusion 13 of the heat-dissipating unit has two fasteners 131 disposed on its both sides, respectively. The protrusion 13 has a stepped bending portion with a through hole 132 on its surface, and the through hole 132 can accelerate the movement of airflow. Certainly, the fastener 131 and the through hole 132 are optionally used depending on the product demands.

According to the user's requirement, the heat-dissipating unit can be symmetrically or unsymmetrically designed with two bending portions, three bending portions or six bending portions, etc. The bending portion is attached by the heat source for transmitting heat to the cone-like radiating surface. As shown in FIG. 1B, the protrusion 13 of the heat-dissipating unit is a stepped bending portion without through hole.

In addition, the surface of the heat-dissipating unit can be further processed by surface treatment or provided with a microstructure. The microstructure can be formed by a physical or chemical process such as the anodic treatment or coating a material with high heat radiation, for increasing the heat-dissipating area and enhancing heat-radiating effect.

Moreover, the heat-dissipating unit further includes a plurality of apertures 14, as shown in FIG. 1A, for increasing the heat-dissipating area and guiding the airflow to the central opening 12. The cone-like portion 11 can be formed by a plurality of fins as shown in FIG. 1A, or a single annular fin as shown in FIG. 1B.

Figure 3:
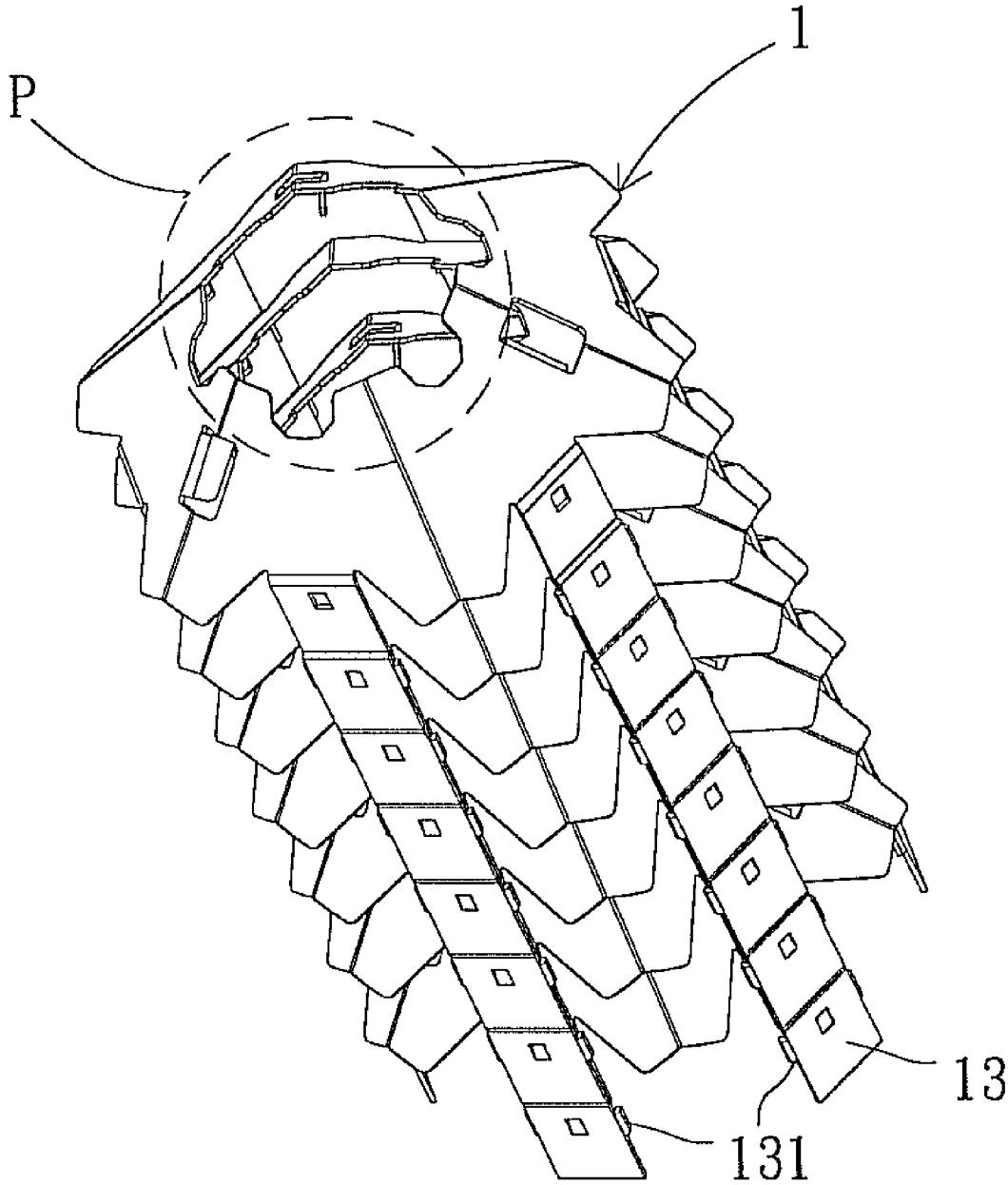
FIG. 3 is a perspective diagram of the heat-dissipating structure formed by assembling a plurality of heat dissipating units as shown in FIG. 1A.
Figure 4A:
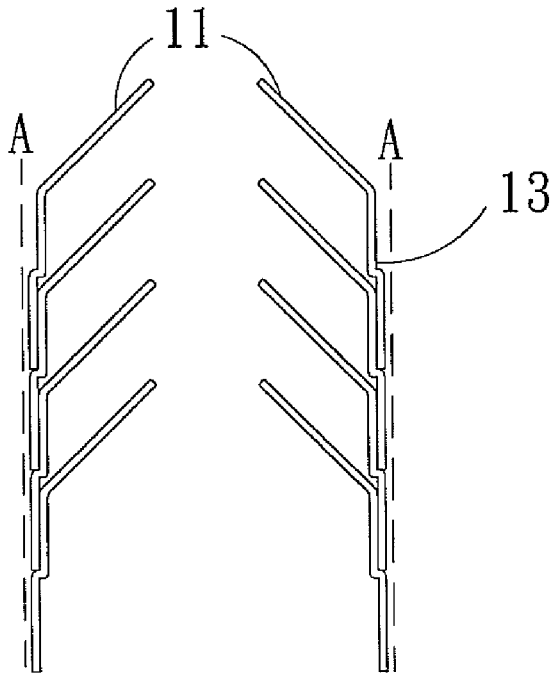
FIG. 4A and FIG. 4B are schematic diagrams showing different stacked types of a plurality of the bending portions of the heat-dissipating structure shown in FIG. 3.
Figure 4B:
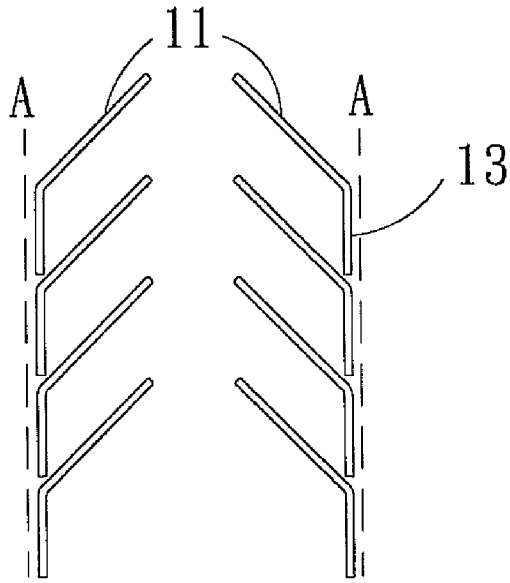

When the heat-dissipating units, as shown in FIG. 1A, are stacked together, the chimney-shaped heat-dissipating structure can be formed as shown in FIG. 3. While the heat-dissipating units are stacked together, the bending portions close to each other and form a plane A as shown in FIG. 4A and FIG. 4B. The plane A allows the light source to be disposed thereon, and serves as a medium of the heat transmission. The bending portion can be designed as a bending portion with height difference or a stepped bending portion, and the height difference of one bending portion can receive another bending portion as shown in FIG. 4A. The bending portion can be also a planar bending portion as shown in FIG. 4B. Optionally, the bending portion can be provided with a fastener 131 for positioning and connecting with the adjacent bending portion as shown in FIG. 3. Thus, the plurality of the heat-dissipating units can position and connect to each other while being stacked together.

After assembling the plurality of the heat-dissipating units as shown above, the openings of the plurality of the heat-dissipating emits are linked together and form a central airflow passage P as shown in FIG. 3. There is a gap between two adjacent cone-like portions for allowing the airflow to pass therethrough. Therefore, the cold airflow will pass through the surface of the heat-dissipating structure and take heat away. The airflow passage P can accelerate movement of the airflow passing through the cone-like surface of the heat-dissipating unit because of the structural characteristic.

Figure 5A:
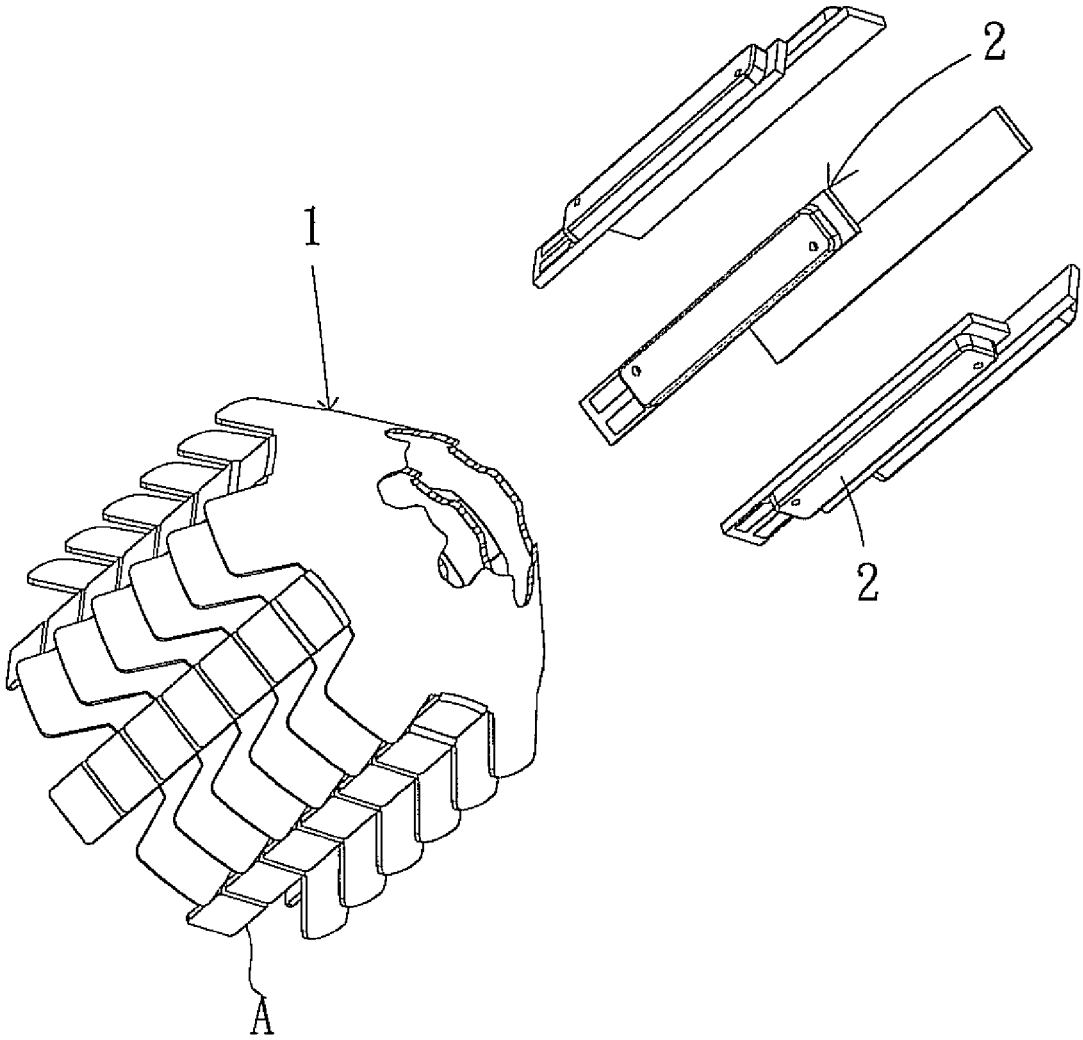
FIG. 5A is a perspective diagram of the heat-dissipating structure of the present invention and the light source before being assembled.
Figure 5B:
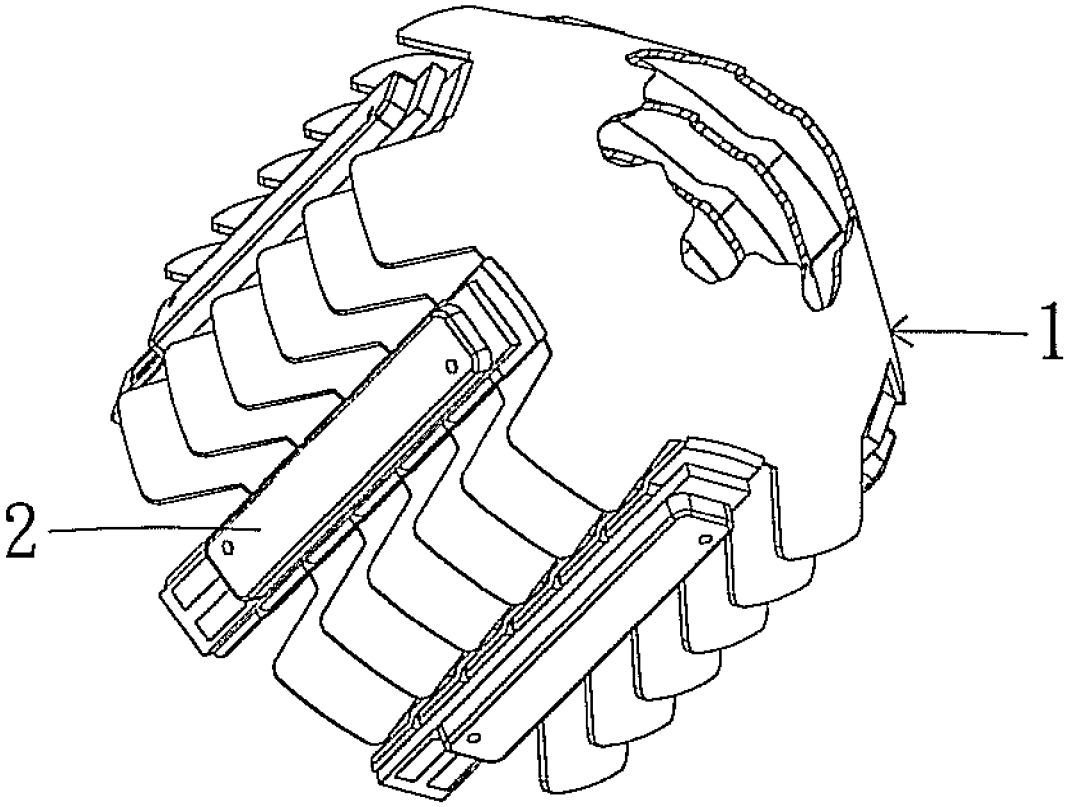
FIG. 5B is a perspective diagram of the heat-dissipating structure of the present invention and the light source after being assembled.

Referring to FIG. 5A and FIG. 5B, a heat-dissipating structure includes a plurality of heat-dissipating units stacked together. While the heat-dissipating units are stacked together, the bending portions close to each other to form a plane. The heat-dissipating unit with N bending portions will form N zonal planes A, and N light sources 2 can be attached on the zonal planes A, respectively. The light source can be a semiconductor light source such as a light emitting diode (LED), a laser diode or an organic light emitting diode (OLED).

According to the present invention, the heat-dissipating area of the umbrella-shaped cone-like heat-dissipating unit is larger than that of the conventional heat sink. Thus, the heat generated from the light source can be transmitted to the cone-like heat-dissipating surface rapidly by heat conduction, and the multi-directional airflow can be guided to surface by heat convection. The heat is dissipated outside through the airflow convection formed by physical principle of heat airflow moving upward.

Figure 6A:
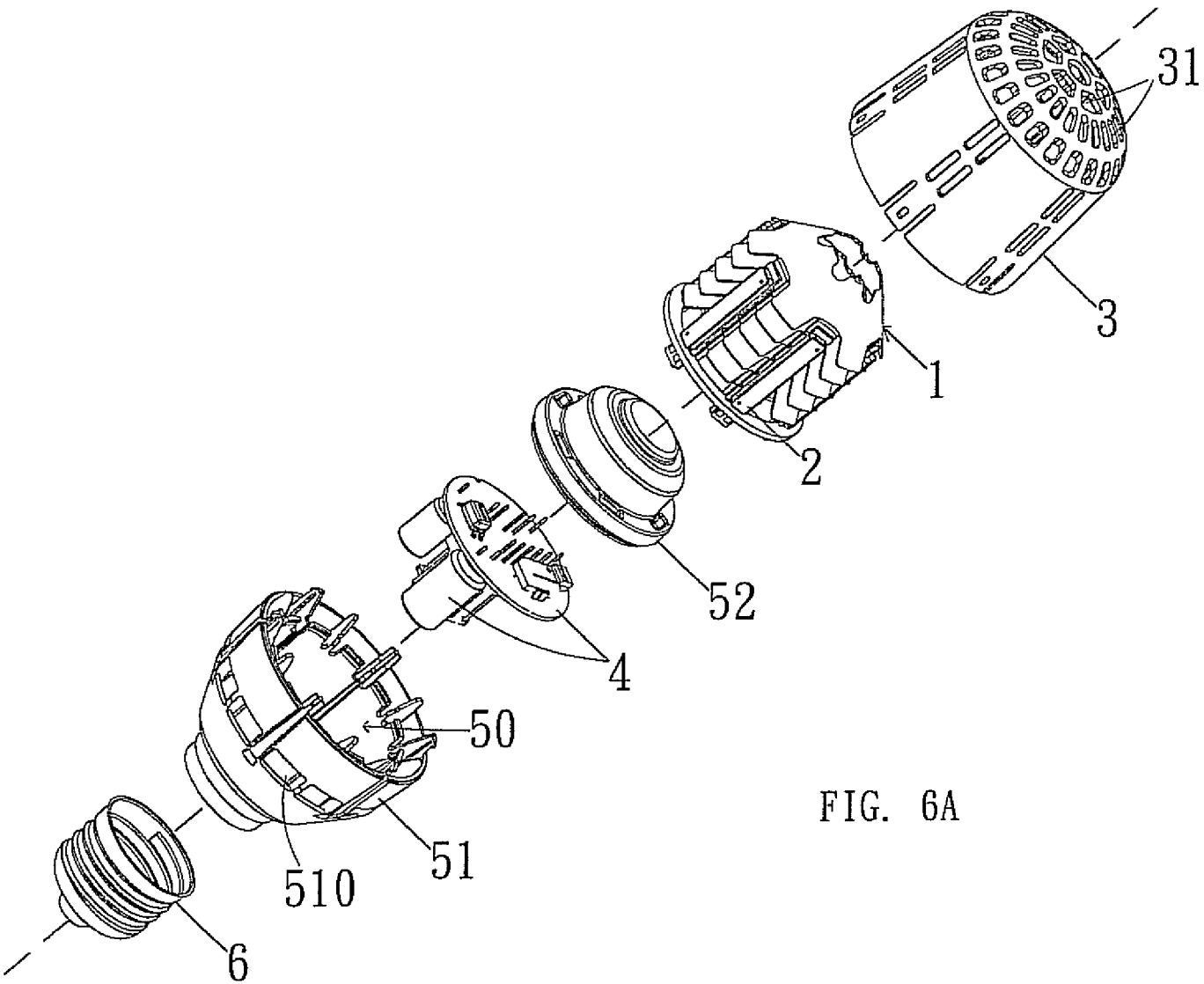
FIG. 6A is an exploded view of the illuminating device according to the present invention before being assembled.
Figure 6B:
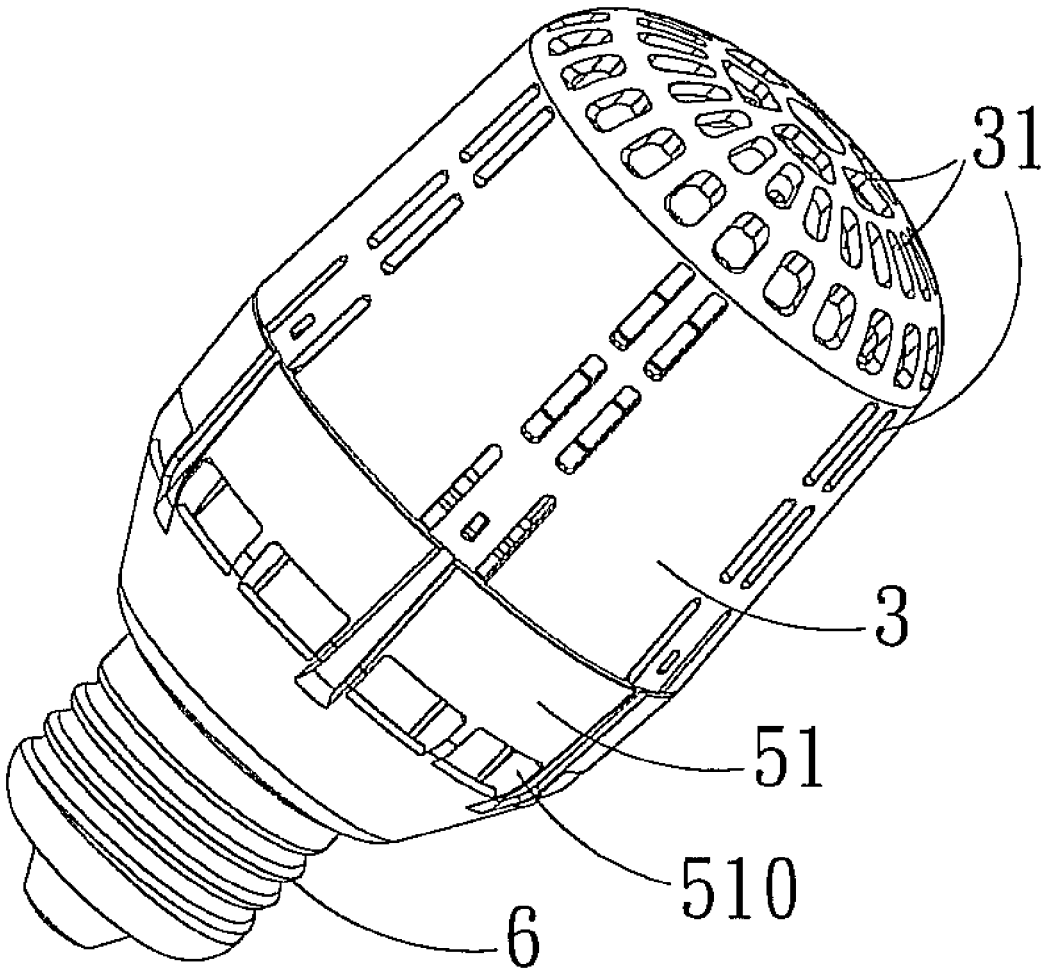
FIG. 6B is a perspective view of the illuminating device of the present invention after being assembled.

Referring to FIG. 6A and FIG. 6B, an embodiment of the illuminating device according to the present invention includes a combination of the heat-dissipating structure 1 and the light source 2 as shown in FIG. 5B, a transparent cover 3, a securing structure, an electric component 4 and a power connector 6. The power connector 6 is E10/E11, E26/E27 or E39/E40. Of course, if the light source 2 is an alternating current LED, the electric component 4 can be omitted. The transparent cover 3 further includes a plurality of vents disposed thereon circumambiently for increasing airflow and decreasing temperature to achieve the effect of cooling the heat-dissipating structure. Certainly, these vents 31 are optionally used depending on the product demands. The securing structure includes a first part 51 and a second part 52, and the electric component 4 can be disposed in a space 50 defined between the first part 51 and the second part 52. The combination of the heat-dissipating structure 1 and the light source 2 can be fixed on the surface of the second part 52 by engagement or other equivalent way. Optionally, a plurality of through holes 510 can be disposed on the first part 51.

Figure 7A:
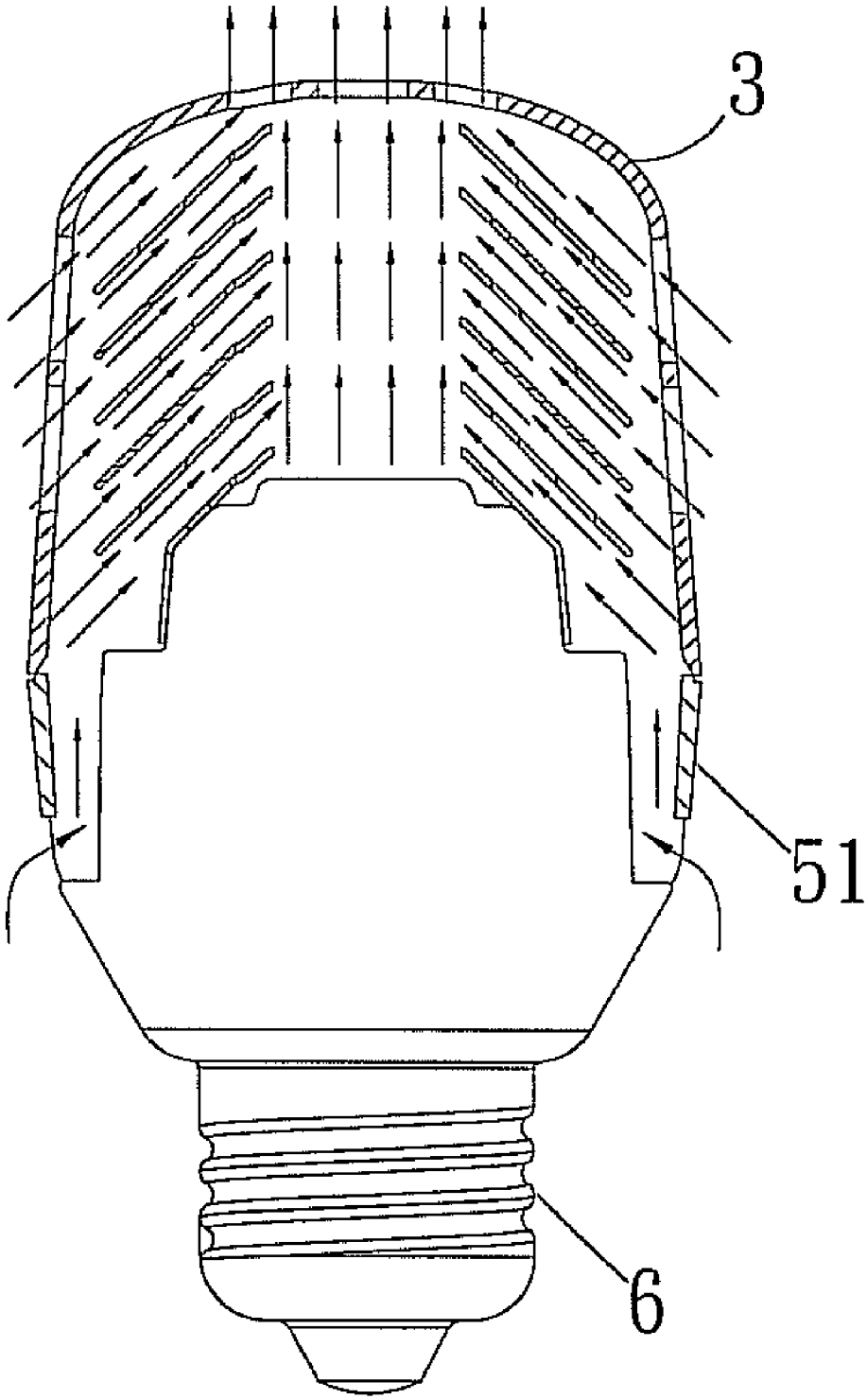
FIG. 7A is a schematic diagram showing the airflow of the illuminating device of the present invention of FIG. 6B while being in vertical position.
Figure 7B:
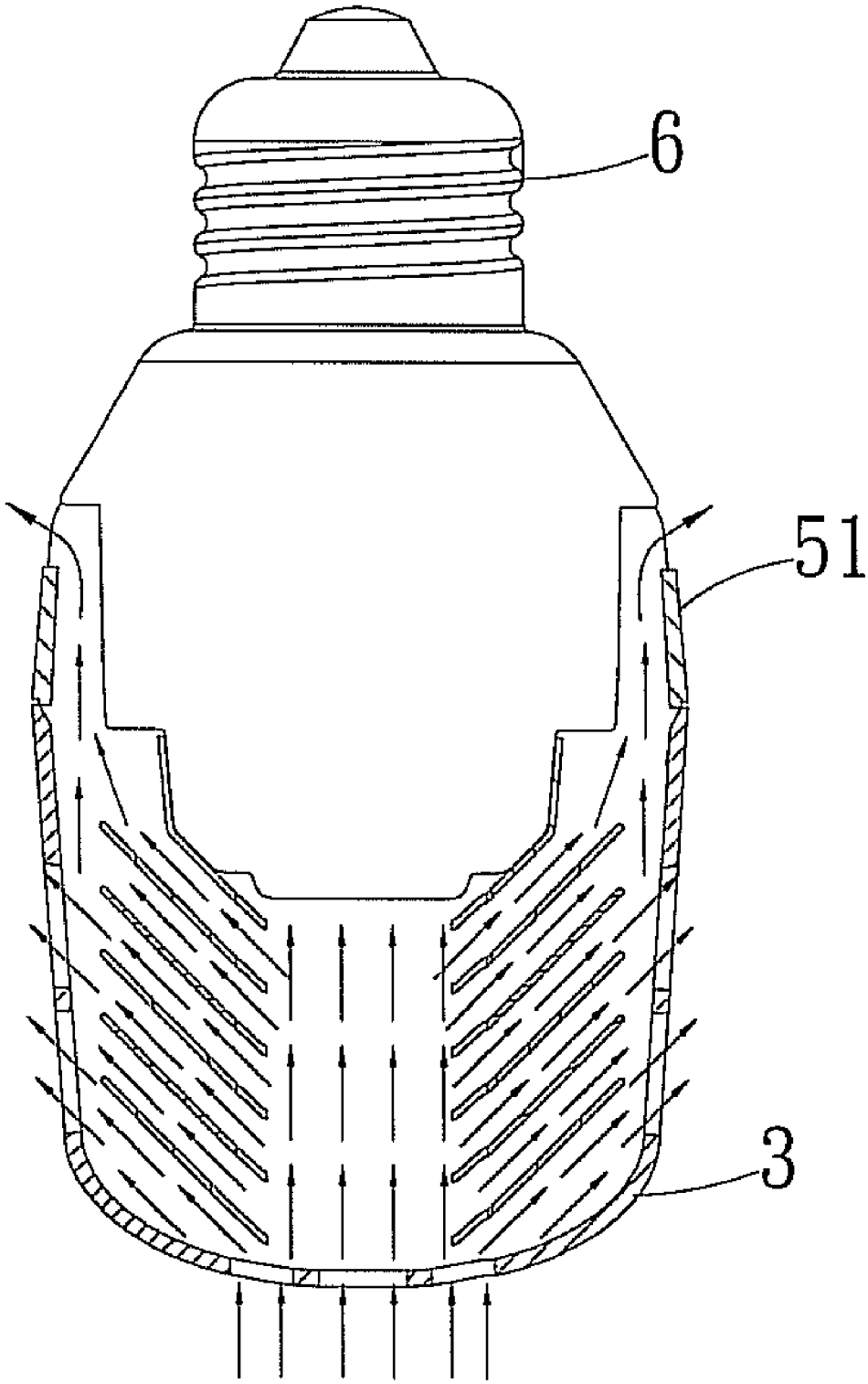
FIG. 7B is a schematic diagram showing the airflow of the illuminating device of the present invention of FIG. 6B while being in inverse position.
Figure 7C:
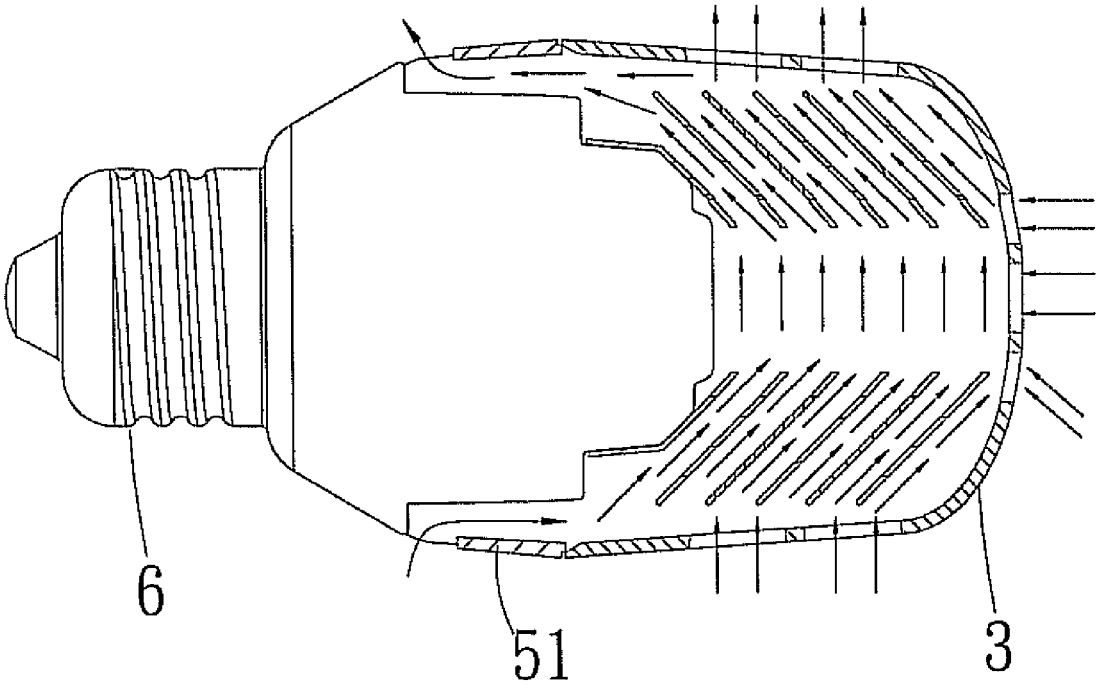
FIG. 7C is a schematic diagram showing the airflow of the illuminating device of the present invention of FIG. 6B while being in horizontal position.

While the illuminating device, as shown in FIG. 6B, is configured in vertical or inverse position, a chimney effect is formed in the central airflow passage P. The chimney effect is useful to enhance the effect of convection and heat dissipation. Please refer to FIG. 7A showing the illuminating device while being in vertical position. The cold airflow passes through the vents of the transparent cover 3, the first part 51, and the gaps between the heat-dissipating units, and converges together in the central airflow passage P finally. Thus, the airflow passes through the cone-like surface of the heat-dissipating structure and dissipates heat by the way of heat transmission and heat convection. Please refer to FIG. 7B the illuminating device in the inverse position, and the direction of the airflow is contrary with that of FIG. 7A. Additionally, while the illuminating device is in horizontal position, the airflow can also pass through the cone-like surface of the heat-dissipating structure successfully. The airflow enters the central airflow passage of the illuminating device from underside vents, and is discharged from upside vents as shown in FIG. 7C. Therefore, the heat-dissipating structure of the illuminating device according to the present invention can be used to dissipate heat in all position.

Figure 8A:
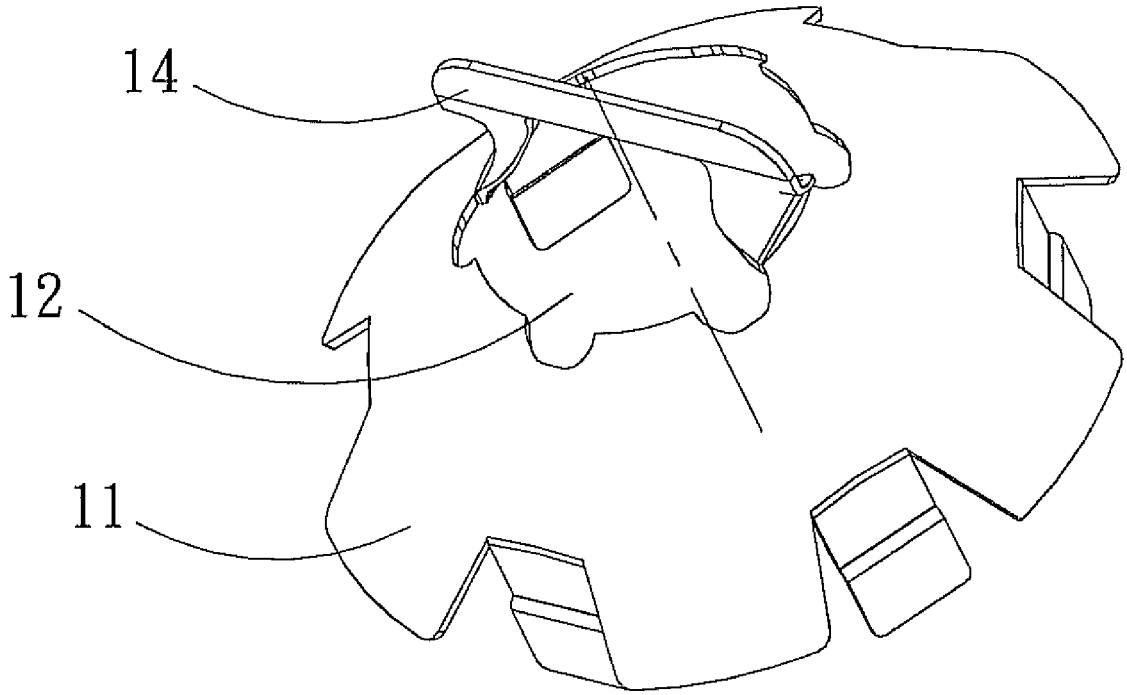
FIG. 8A is a perspective view of another type of the heat-dissipating unit according to the present invention.
Figure 8B:
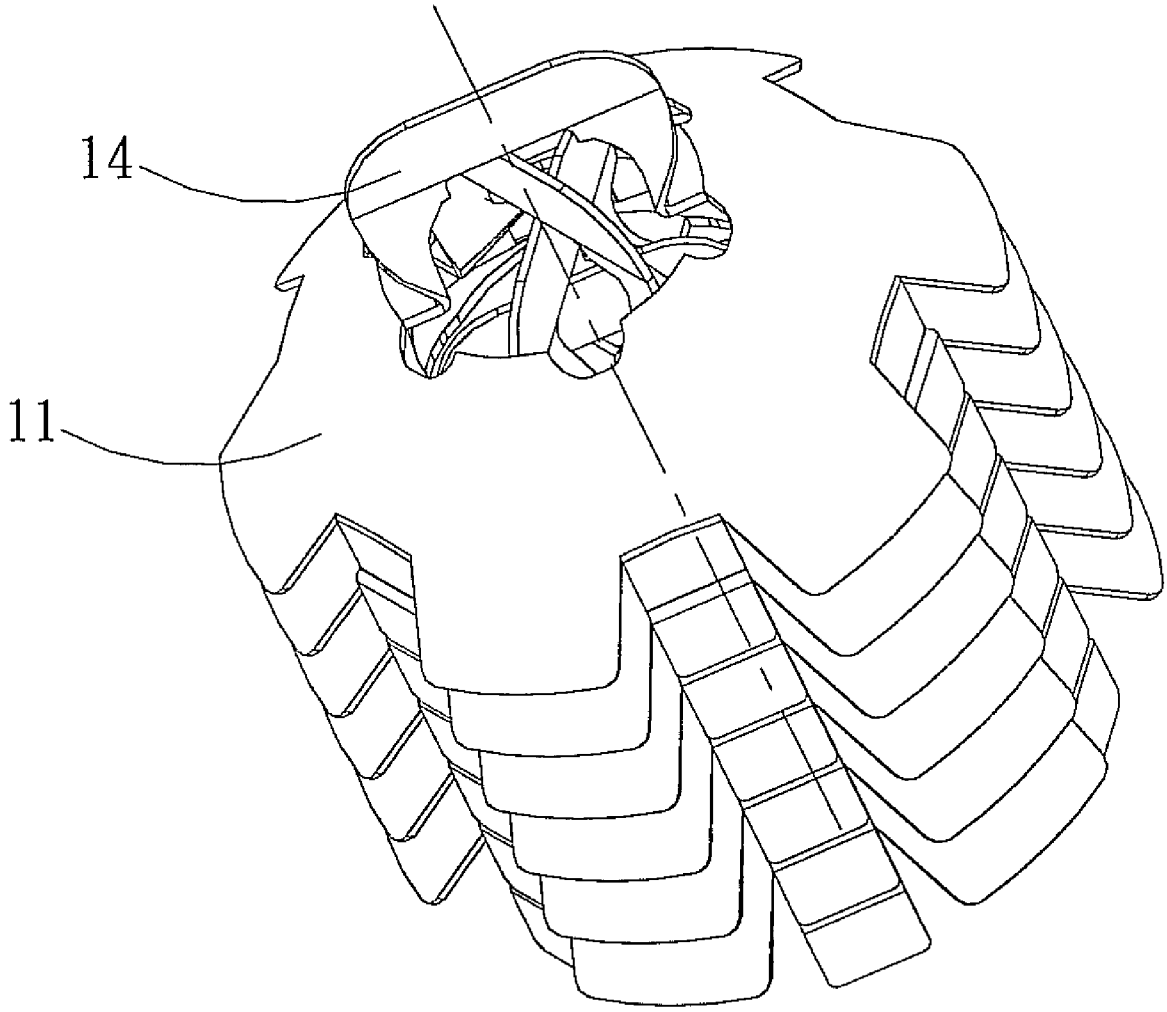
FIG. 8B is a perspective diagram of the heat-dissipating structure formed by assembling a plurality of heat dissipating units as shown in FIG. 8A.

Please refer to FIG. 8A and FIG. 8B respectively showing another type of the heat-dissipating unit and the heat-dissipating structure of the present invention. The structure of the heat-dissipating unit is similar to FIG. 1B except that the heat dissipating unit further includes a rod portion 14 located across the opening 12 and connected to the cone-like portion 11 as shown in FIG. 8A. The rod portion 14 is used for increasing the heat-dissipating area and guiding the airflow. The rod portion 14 is disposed in various angles for guiding the airflow while the heat-dissipating units are stacked together as shown in FIG. 8B. Preferably, the rod portions of the heat-dissipating units are laid across each other so that the cross section of central airflow passage is divided into several parts for guiding the airflow respectively to improve heat-dissipating efficiency.

In conclusion, the illuminating device and the heat-dissipating structure of the present invention provide multi-directional natural convection and can be configured in any position. Thus the present invention achieves the chimney-like effect to accelerate the dissipation of heat through the central airflow passage. Moreover, the heat-dissipating structure of the present invention is made by stamping thin metals and stacking them together. Compared with the conventional heat sinks, the heat-dissipating structure of the present invention has the advantages of a large increase of heat-dissipating area, a reduction of material usage, and the conservation of energy and cost.

Furthermore, the heat-dissipating stricture of the present invention includes a plurality of heat-dissipating units stacked together with bending portions. While the heat-dissipating units are stacked together, the multi-side bending portions of adjacent heat-dissipating units close to each other to form a plane for allowing the light source to be disposed thereon. The plurality of light sources are disposed on the surface of the heat-dissipating structure circumambiently so that they can illuminate in 360° to achieve the best lighting level rather than being limited to a single direction.

While the invention has been described in connection with what is presently considered to be the most practical and preferred embodiment, it is to be understood that the invention is not limited to the disclosed embodiments, but, on the contrary, is intended to accommodate various modifications and equivalent arrangements included within the spirit and scope of the appended claims.

What is claimed is:

1. A heat-dissipating structure comprising:

a plurality of heat-dissipating units stacked together with at least a portion of one heat-dissipating unit being overlapped and covered by an adjacent heat-dissipating unit, wherein each heat-dissipating unit comprises a cone-shaped portion with an opening and the openings of the stacked heat-dissipating units being aligned; and a plurality of protrusions connected to the like cone-shaped portion, wherein at least one of the protrusions of one heat-dissipating unit is coupled to that of the adjacent heat-dissipating unit to form a plane and the openings of the heat-dissipating units are linked together to form an airflow passage, a heat source being mounted on the plane extending between adjacent heat-dissipating units so as to bridge multiple heat-dissipating units.

2. The heat-dissipating structure of claim 1, wherein the heat-dissipating unit is formed by metal stamping.

3. The heat-dissipating structure of claim 1, wherein the heat-dissipating unit is a pyramid, a conoid, or an umbrella-shaped unsymmetrical structure.

4. The heat-dissipating structure of claim 1, wherein the protrusion has a fastener for positioning and connecting with the adjacent protrusion.

5. The heat-dissipating structure of claim 1, wherein the protrusion has a planar or stepped bending portion.

6. The heat-dissipating structure of claim 1, wherein the surface of the protrusion has a through hole for accelerating movement of the airflow.

7. The heat-dissipating structure of claim 1, wherein the plurality of protrusions are symmetrically or unsymmetrically disposed on the edge of the cone-shaped portion.

8. The heat-dissipating structure of claim 1, wherein the surface of the heat-dissipating unit is processed physically or chemically for accelerating heat-radiation.

9. The heat-dissipating structure of claim 1, wherein the surface of the heat-dissipating unit is processed with anodic treatment or coated with a high heat-radiating material or has a microstructure.

10. The heat-dissipating structure of claim 1, wherein the heat-dissipating unit further includes a plurality of apertures.

11. The heat-dissipating structure of claim 1, wherein the cone-shaped portion is formed by a plurality of fins or a single annular fin.

12. The heat-dissipating structure of claim 1, wherein there is a gap between two adjacent cone-shaped portions for allowing the airflow to pass therethrough.

13. The heat-dissipating structure of claim 1, wherein the heat-dissipating unit further includes a rod portion located across the opening and connected to the cone-shaped portion.

14. The heat-dissipating structure of claim 13, wherein the rod portions of the heat-dissipating units are laid across each other.

15. The heat-dissipating structure of claim 1, wherein each of the protrusions have a stepped portion with an inner section and an outer section, the inner section being between the cone-shaped portion and the outer section of the protrusion, when at least three heat-dissipating units are stacked together, an outer section of a protrusion of a first heat-dissipating unit rests against an inner section of a protrusion of an adjacent, second heat-dissipating unit and an outer section of a protrusion of the second heat-dissipating unit rests against an inner section of a protrusion of an adjacent, third heat-dissipating unit so that the outer sections of the first, second and third heat-dissipating units are flush and form the plane.

16. A heat-dissipating structure comprising:

a plurality of heat-dissipating units stacked together, each of which comprises a cone-shaped portion with an opening for air flow; and at least one protrusion connected to the cone-shaped portion, the at least one protrusion being connected to an opposite side of the heat-dissipating unit from a side adjacent the opening, the at least one protrusion being connected to the cone-shaped portion at a non-right angle, wherein the at least one protrusion of one heat-dissipating unit is coupled to that of the adjacent heat-dissipating unit to form a plane extending between multiple heat-dissipating units, a heat source being mounted on the plane extending between adjacent heat-dissipating units to bridge multiple heat-dissipating units.

17. An illuminating device comprising:

a heat-dissipating structure comprising a plurality of heat-dissipating units stacked together, each of which comprises a cone-shaped portion with an opening; and a protrusion connected to the cone-shaped portion wherein the at least one protrusion of one heat-dissipating unit is coupled to that of the adjacent heat-dissipating unit to form a plane; and a light source disposed on the plane and bridging between at least one pair of adjacent heat-dissipating units, a back of the light source being parallel to a longitudinal axis passing through a center of the openings of the heat-dissipating units stacked together.

18. The illuminating device of claim 17, further comprising a transparent cover disposed outside of the heat-dissipating structure and the light source.

19. The illuminating device of claim 18, wherein the transparent cover has one or more vents.

20. The illuminating device of claim 17, further comprising a securing structure used to fasten the heat-dissipating structure.

21. The illuminating device of claim 20, wherein the securing structure comprises a first part and a second part, and the illuminating device further comprises an electric component disposed in a space formed between the first part and the second part of the securing structure.

22. The illuminating device of claim 20, wherein the securing structure has one or more through holes.

23. The illuminating device of claim 17, further comprising a power connector.

* * * * *